US007746191B2

(12) United States Patent
Tong et al.

(10) Patent No.: US 7,746,191 B2
(45) Date of Patent: Jun. 29, 2010

(54) WAVEGUIDE TO MICROSTRIP LINE TRANSITION HAVING A CONDUCTIVE FOOTPRINT FOR PROVIDING A CONTACT FREE ELEMENT

(75) Inventors: Dominique Lo Hine Tong, Rennes (FR); Philippe Minard, Saint Medard sur Ille (FR); Corinne Nicolas, La Chapelle des Fougeretz (FR); Ali Louzir, Rennes (FR); Julian Thevenard, Laiz (FR); Jean-Philippe Coupez, Le Relecq Kerhuon (FR); Christian Person, Locmaria Plouzané (FR)

(73) Assignee: Thomson Licensing, Boulogne-Billacourt (FR)

( * ) Notice: Subject to any disclaimer, the term of this patent is extended or adjusted under 35 U.S.C. 154(b) by 935 days.

(21) Appl. No.: 11/110,422

(22) Filed: Apr. 20, 2005

(65) Prior Publication Data

US 2006/0097819 A1 May 11, 2006

(30) Foreign Application Priority Data

Apr. 29, 2004 (FR) ..... 04 50834
Sep. 14, 2004 (FR) ..... 04 52037
Oct. 19, 2004 (FR) ..... 04 52373

(51) Int. Cl.
*H01P 5/107* (2006.01)

(52) U.S. Cl. ..... 333/26; 333/33

(58) Field of Classification Search ..... 333/26, 333/33
See application file for complete search history.

(56) References Cited

U.S. PATENT DOCUMENTS 2,897,461 A 7/1959 Ashbaugh et al.
4,562,416 A 12/1985 Sedivec
5,528,074 A * 6/1996 Goto et al. ..... 257/664
5,912,598 A * 6/1999 Stones et al. ..... 333/26
6,967,543 B2 * 11/2005 Ammar ..... 333/26

FOREIGN PATENT DOCUMENTS

JP 2001267814 9/2001

OTHER PUBLICATIONS

Frank J. Villegas, D. Ian Stones and H. Allred Hung, A Novel Waveguide-to-Microstrip Transition for Millimeter-Wave Module Applications, XP-000793256. IEEE Transactions on Microwave Theory and Techniques, vol. 47, No. 1, Jan. 1999, Search Report.

* cited by examiner

*Primary Examiner*—Benny Lee
(74) *Attorney, Agent, or Firm*—Robert D. Shedd; Joseph J. Opalach; Brian J. Cromarty

(57) ABSTRACT

The present invention relates to an element of transition between a waveguide and a transition line on a substrate. The element of transition comprises a securing flange on the substrate, the flange being dimensioned so that at least, in the direction microstrip line, the width d of the flange is selected in such a manner as to shift the resonant modes away from the useful band. The invention is used particularly for circuits using SMD techniques at millimeter frequencies.

11 Claims, 8 Drawing Sheets

(a) (b)

(a)

(b)

(a)

(b)

WAVEGUIDE TO MICROSTRIP LINE TRANSITION HAVING A CONDUCTIVE FOOTPRINT FOR PROVIDING A CONTACT FREE ELEMENT

The present invention relates to a transition element between a microstrip technology line circuit and a waveguide circuit, more particularly a contact-free transition between a microstrip technology feeding line and a rectangular waveguide realized by using metallized foam based technology.

BACKGROUND OF THE INVENTION

Radio communication systems that can transmit high bit-rates are currently experiencing strong growth. The systems being developed, particularly the point-to-multipoint systems such as the LMDS (Local Multipoint Distribution System) systems and WLAN (Wireless Local Area Network) wireless systems, operate at increasingly higher frequencies, namely in the order of several tens of Giga-Hertz. These systems are complex but must be realized at increasingly lower costs due to their use by consumers. There are now technologies such as LTCC (Low Temperature Cofired Ceramic) or HTCC (High Temperature Cofired Ceramic) technologies that enable devices integrating passive and active functions operating at the above frequencies to be realized at low cost on a planar substrate.

However, some functions are difficult to realize in the millimetric band, particularly filtering functions, because the substrates that must be used in this case do not have the qualities required at the millimeter-waveband level. This type of function must therefore be realized by using conventional structures such as waveguides. Problems then arise with the interconnection of the waveguide device and the printed circuit realized using microstrip technology designed for use by the other functions of the system.

On the other hand, for identical reasons depending on their operation in millimeter wave frequencies, the antennas and their associated elements, such as filters, polarizers or ortho-mode transducers, are also realized using waveguide technology. It is therefore necessary to be able to connect the circuits realized using waveguide technology to the planar structures realized using conventional printed circuit technology, this latest technology being suitably adapted for mass-production.

Consequently, many studies have been conducted on the interconnection between a waveguide structure and a planar structure in microstrip technology. Hence, the article of the 33$^{rd}$ European Microwave Conference at Munich, in 2003, page 1255, entitled "Surface mountable metallized plastic waveguide filter suitable for high volume production" of Muller et al, EADS, describes a waveguide filter capable of being connected to multilayer PCB (Printed Circuit Board) circuits by using the SMD (Surface Mounted Device) technique. In this case, the input and output of the waveguide filter are soldered directly onto footprints realized on the printed circuit. These footprints supply a direct connection to a microstrip line. Hence, the excitation of the waveguide mode is carried out by direct contact between the microstrip access lines and the guide structure. This transition therefore proves complicated to realize and requires stringent manufacturing and positioning tolerances.

A transition between a rectangular waveguide and a microstrip line has also been proposed in French patent 03 00045 filed on Jan. 3, 2003 in the name of THOMSON Licensing S. A. This transition requires modelling the extremity of the waveguide in a particular manner and realizing the microstrip line on a foam substrate extending the foam structure in which the ribbed waveguide is realized. In this case the foam bar forming the waveguide is also used as a substrate for the microstrip line. This type of substrate is not always compatible with the realization of passive or active circuits.

SUMMARY OF THE INVENTION

In all cases, the embodiments described above are complex and inflexible.

The present invention therefore proposes a new type of contact-free transition between a waveguide structure and a structure realized using microstrip technology. This transition is simple to realize and allows wide manufacturing and assembly tolerances. Moreover, the transition of the present invention is compatible with the SMD mounting technology.

The present invention relates to a transition element for a contact-free connection between a waveguide circuit and a microstrip technology line realized on a dielectric substrate. The transition element extends the extremity of the waveguide by a flange for securing to the substrate, said substrate featuring a conductive footprint for realizing the connection with the lower surface of the flange. In addition, to realize the adaptation of the transition, a cavity is realized opposite the extremity of the waveguide under the substrate, this cavity presenting specific dimensions.

Preferably, the waveguide circuit and the securing flange are realized in a block of synthetic material such as foam with the external surfaces metallized except for the zone opposite the cavity.

Moreover, the securing flange is preferably integral with the extremity of the waveguide. However, for some embodiments, the securing flange is an independent element being fixed to the extremity of the waveguide.

According to a first embodiment, the securing flange is dimensioned so that, at least in the direction of the microstrip line, the width d of the flange is chosen to shift the resonating modes away from the useful bandwidth, the securing flange being at least perpendicular to the extremity of the waveguide. In this case, the cavity has a depth equal to $\lambda/4$ where $\lambda$ corresponds to the guided wavelength in the waveguide and the microstrip line terminates in a probe.

According to a second embodiment, the securing flange is realized in the extension of the waveguide. In this case, the microstrip line preferably terminates in a capacitive probe and the cavity has a depth between $\lambda/4$ and $\lambda/2$ where $\lambda$ corresponds to the guided wavelength in the waveguide. To prevent electrical leakage, the conductive footprint is realized on the substrate to enable the connection with a C-shaped flange, the opening between the branches of the C-shaped footprint being dimensioned to limit the leakage of electrical fields while preventing short-circuits.

According to a third embodiment, the waveguide is formed by a hollowed out block of dielectric material of which the outer surface is metallized. In this case the C shaped conductive footprint realized on the substrate extends in the direction of the waveguide in such a manner as to form the lower part of the waveguide. The footprint must preferably comprise a first metallized zone to which the waveguide is welded and a second metallized zone inside the first and forming a cover for the waveguide.

BRIEF DESCRIPTION OF THE DRAWINGS

Other characteristics and advantages of the present invention will emerge upon reading the description of diverse embodiments, this reading being made with reference to the figures attached in the appendix, in which:

FIG. 1' is an exploded perspective view of a securing flange independent of the waveguide circuit.

DETAILED DESCRIPTION OF PREFERRED EMBODIMENTS

A first description with reference to FIGS. 1 to 4 will be made for a first embodiment of a transition element between a waveguide circuit and a microstrip line realized on a dielectric substrate.

Figure 1:
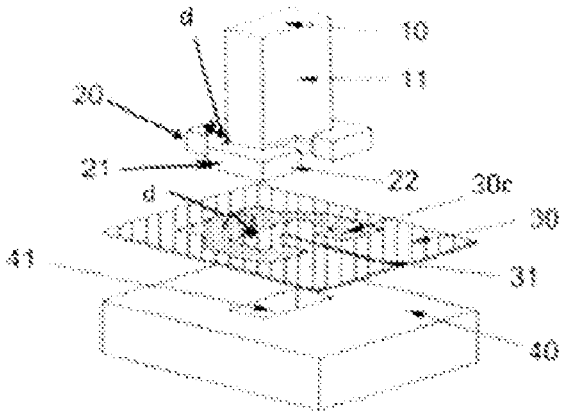
FIG. 1 is an exploded perspective view of a first embodiment of a transition element between a waveguide circuit and a microstrip technology line in accordance with the present invention.
Figure 1:
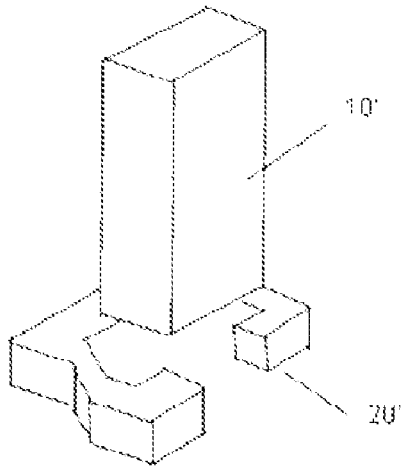

As shown diagrammatically in FIG. 1, which relates to an exploded view of the transition element, the reference 10 diagrammatically shows a rectangular waveguide. This waveguide is preferably realized in a synthetic material, more particularly in foam with a permittivity noticeably similar to that of air. The rectangular block of foam is metallized, as referenced by 11, on all the external surfaces so as to realize a microwave waveguide.

As shown particularly in FIG. 1, a flange 20, which presents a noticeable "C" shape, is realized at one end of the guide 10, preferably at the same time as the foam technology waveguide. This flange 20 surrounds the rectangular extremity of the guide 10 on its two smaller sides 21 and on one of its large sides while the other large side has an opening 22 positioned in such a manner as to prevent any short circuit with the microstrip line 31 realized on a dielectric substrate 30, as will be explained subsequently.

In FIG. 1', there is represented a rectangular waveguide 10' and independent securing flange 20' that is fixed at the end of waveguide 10'.

Figure 3:
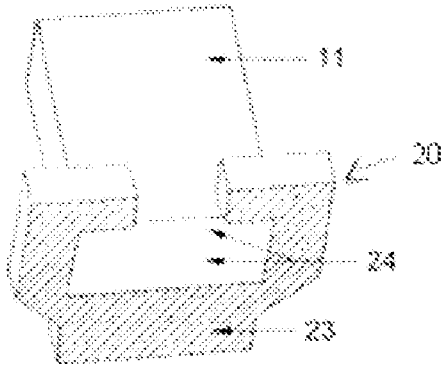
FIG. 3 is a perspective view of the transition element integrated with the waveguide.

As shown more clearly in FIG. 3, the assembly formed by the rectangular waveguide and the transition element constituted by the flange is metallized in zones 11 and 23. However, the extremity corresponding to the output of the waveguide forming a rectangular zone together with the zone that is vertically at the level of the break in the flange 20 are non-metallized as shown by 24.

This flange 20 constituted by a partly metallized foam structure forms a millimeter waveguide cavity that can disturb and degrade the transition performances. To prevent this problem and in accordance with the present invention, the flange 20 was dimensioned specifically to obtain a reliable electric contact with the substrate carrying the microstrip technology circuits as will be explained hereafter, while ensuring good mechanical support for the assembly and by eliminating the resonating modes.

Hence, the part of the flange 20 opposite the non-metallized part 22, which corresponds to the part opposite the microstrip line, is dimensioned so as to shift the resonance frequency of the flange outside the operating frequency band. The thickness of the flange being selected according to the mechanical strength required, the dimension d of this part of the flange will be selected such that the resonant frequency generated is outside the operating frequency band. Moreover, the microstrip technology circuits are realized on a dielectric substrate 30, as shown in FIG. 1. In a more specific manner, as shown in FIG. 2*b*, the dielectric substrate 30 comprises a metal layer 30*a* forming a ground plane on its lower face with a rectangular non-metallized zone 30*b* corresponding to the rectangular output of the waveguide 10 and next to a cavity 41 realized in the box or base 40 supporting the substrate 30, as will be explained hereafter.

The upper face of the substrate shown in FIG. 2*a* comprises a microstrip technology line 31*a* that is extended by an impedance matching line 31*b* using microstrip technology and a connection element or probe 31*c* for recovering the energy emitted by the waveguide 10. This element normally being known under the English term "Probe".

To enable the connection between the waveguide output and the probe 31*c*, a footprint 30*c* of the lower face of the flange 20 was realized in a conductive material on the upper face of the substrate 30. As clearly shown in FIG. 2*a*, the part of the footprint being found in the extension of the probe 31*c* has a width d corresponding to the width d of the part of the flange 20 that is fixed to the footprint as shown in FIG. 1.

The metallized zone 30*c* is used to receive the equivalent surface of the flange which is connected by welding, more particularly by soldering, and this zone is connected electrically to the ground plane 30*a* by metal holes not shown.

Moreover, as shown in FIG. 1, the dielectric substrate receiving the microstrip technology circuits is mounted on a metal base or metal box 40 featuring a cavity 41 in the part facing the waveguide. This cavity has an opening equal to that of the rectangular waveguide and a depth noticeably equal to a quarter of the wavelength guided in the waveguide, this is to provide impedance matching for the transition.

For the present invention, it appears that only the width d of the part of the flange of the transition element found in the same direction as the microstrip technology line is of importance with respect to resonance phenomena. Indeed, for a rectangular waveguide as shown in FIG. 1, the fundamental mode TE10 is excited and the electric field is maximum in the axis of the microstrip line and quasi-null laterally on the small sides of the waveguide. Hence, the cavities located on either side of the microstrip line and formed by the lateral parts of the flange, have little effect on the performances and the dimensions of these parts of the flange are selected only to provide mechanical rigidity to the assembly. On the contrary, with respect to the rear flange part, it is excited by the feeding line, which creates a resonant frequency depending on the dimensions of this part, this frequency being able to fall within the operating frequency band. The width d is therefore chosen to shift this resonant frequency from the operating frequency band, the height being chosen according to mechanical constraints.

To validate the concept described above, a transition element associated with a planar structure and a rectangular waveguide of the type of that shown in FIG. 1 was simulated electromagnetically in 3D by using ANSOFT HFSS™ simulation software that implements a finite elements method. In this case, a waveguide of name WR28 having a waveguide cross-section of 3.556 mm×7.112 mm is extended by a flange such as shown in FIG. 1. The flange, which has a thickness of 1.5 mm, a width on the small sides of 2 mm and a width equal to 4 mm or 2.3 mm, was mounted as described above on a low-cost microwave substrate of thickness 0.2 mm, known commercially under the name of R04003 on which a microstrip line was realized.

Moreover, the waveguide is realized by metallizing a foam material known under the commercial name "ROHACELL/HF71" which presents a very low dielectric constant and low dielectric loss where, in particular, $\in r=1.09$, tg. $\delta=0.001$, up to 60 GHz. The results of the simulations are given in FIG. 4*a*, where d=4 mm, and in FIG. 4*b*, where d=2.3 mm. The curves of FIGS. 4*a* and 4*b* represent respectively the transmission (TL) and reflection (RL) parameters of the transition.

Figure 4:
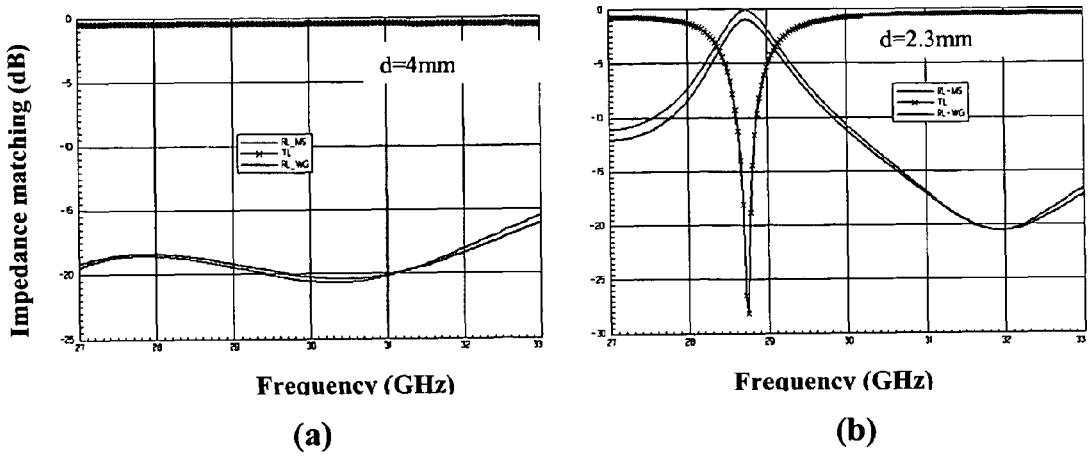
FIG. 4*a* and FIG. 4*b* are curves giving, for the embodiment of FIG. 1, the adaptation characteristics depending on the frequency for a dimension d of the flange in the direction of the microstrip line, such as d=4 mm and d=2.3 mm respectively.

It is observed that, for d=4 mm (FIG. 4(*a*)), an excellent impedance matching of around 18 dB (curves RL MS and RL WG) is obtained over a frequency band of 27 to 32 GHz, whereas, for d=2.3 mm (FIG. 4(*b*)), a disastrous resonance (curve TL) is observed at around 29 GHz.

Figure 5:
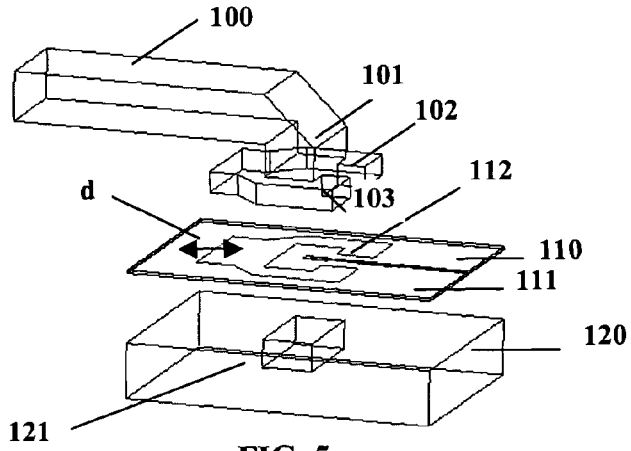
FIG. 5 is an exploded perspective view of an element between a microstrip line and a waveguide bent at 90°, according to a variant of the first embodiment.

In FIG. 5, an embodiment variation of the present invention was shown. In this case, the waveguide 100 is a waveguide bent at 90°, as by the reference 101, comprising a flange 102 at its extremity, the assembly being realized using foam technology, namely by milling a foam block and covering it with a metal layer, as described above. The flange 102 is a flange of the same type as the flange shown in FIG. 1. This flange has a "C" shape and features an opening 103 in the part that must face the microstrip technology feeding line to be coupled to the waveguide.

Figure 2:
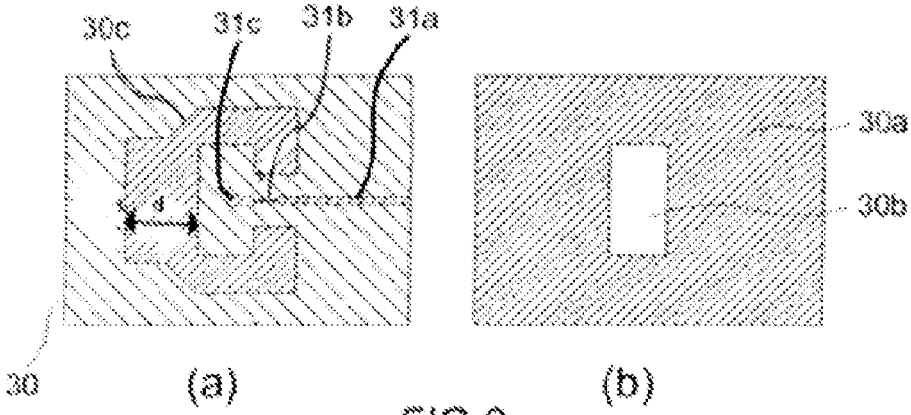
FIG. 2*a* and FIG. 2*b* are respectively a top view and bottom view of the substrate comprising the microstrip technology line used in the first embodiment.

As shown in FIG. 5, a substrate 110 of the same type as the substrate 30 of FIGS. 1 and 2, features a microstrip technology feeding line 111 and a conductive footprint 112 for securing the flange 102. This footprint 112 presents, in the part opposite the feeding line 111, a dimension d with a value determined as mentioned above in a manner that shifts the resonant frequency of this part out of the operating frequency band.

In an identical manner to the embodiment of FIG. 1, this substrate is mounted on a metal base or metal box 120 with a cavity 121, the height of which is equal to $\lambda/4$, $\lambda$ being the guided wavelength in the waveguide.

Figure 6:
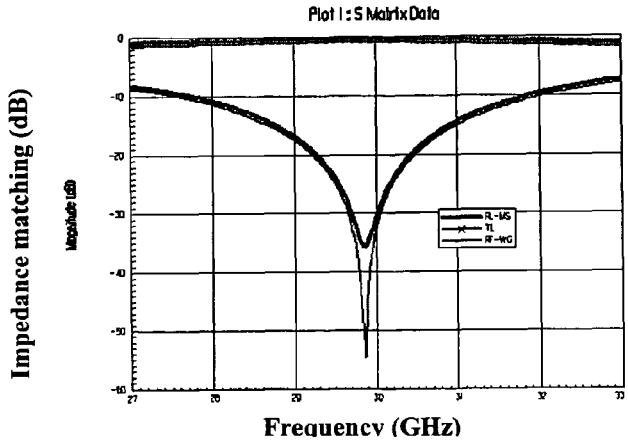
FIG. 6 gives the impedance matching and transmission loss curves as a function of the frequency for the embodiment of FIG. 5.

A system of this type was simulated by using the same software as above, with the same types of materials for the substrate and the waveguide. The dimensions of the bend 101 were optimised for an application at around 30 GHz. The curves for impedance matching as a function of the frequency are shown in FIG. 6. It shows impedance matching of more than 20 dB for 1 GHz of bandwidth around 30 GHz as shown by curves (RL MS and RL WG). The curves of FIG. 6 represent respectively the transmission (TL for d=2.3 mm) and reflection (RL) parameters of the transition.

Figure 7:
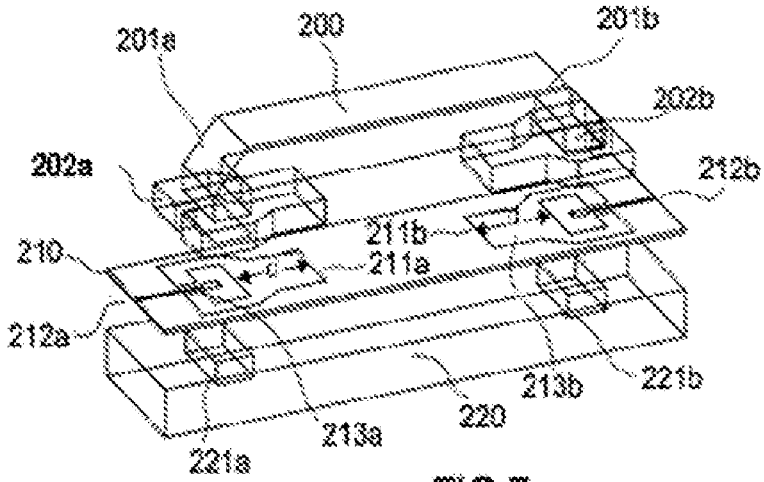
FIG. 7 represents an exploded perspective view of another variant of the first embodiment, for a waveguide with two 90° bends.

In FIG. 7, another embodiment variation was shown with a double waveguide/planar substrate transition, more particularly a straight waveguide 200 realized using foam technology extending at each extremity by a 90° bend 201*a*, 201*b*, each curve extremity extending by a flange 202*a*, 202*b* such as the flange described with reference to FIG. 5. This flange is used to connect the waveguide 200 to input circuits and output circuits realized in microstrip technology on a planar substrate 210, in a microwave dielectric material. At the level of the transition of each waveguide extremity with the microstrip lines on the substrate, footprints 211*a*, 211*b* of the same type as the footprint 112 in FIG. 5 were realized. These footprints surround a non-metallized part 213*a*, 213*b* which is connected to the extremity (or probe) of a microstrip line 212*a*, 212*b* that is used to supply the circuits realized using planar technology. The substrate 210 is mounted on a metal base or metal box 220, presenting cavities 221*a*, 221*b*, opposite the extremities 201*a*, 201*b* of the waveguide 200. The cavities are dimensioned as in the embodiment of FIG. 1.

Figure 8:
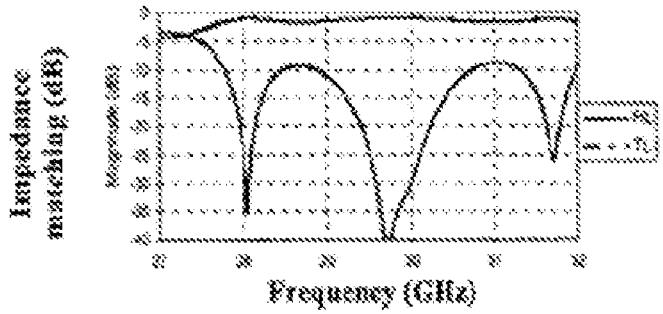
FIG. 8 gives the impedance matching and transmission loss curves as a function of the frequency for the embodiment of FIG. 7.

A structure of this type was simulated as mentioned above and the results of the simulation in terms of impedance matching versus frequency are shown in FIG. 8. The curves of FIG. 8 represent respectively the magnitude in dB versus frequency of the transmission (TL) and reflection (RL) parameters of the transition.

In this case, the level of loss is close to the loss obtained for a single transition at 30 GHz and the simulated insertion loss is less than 1.5 dB for a waveguide length of 42 mm.

Figure 9:
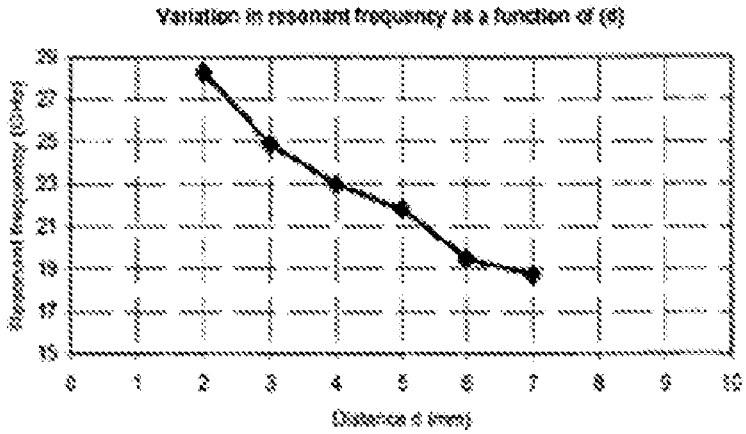
FIG. 9 is a curve showing the variations in the resonant frequency as a function of the dimension d, enabling the limit values of d to be determined.

As mentioned above, the dimension d is selected so that the cavity formed by the part of the flange opposite the part corresponding to the microstrip line resonates at a frequency that is outside the frequency of the operating frequency band. To accomplish this, the resonant frequency of this part depends not only on the value d but also the height and width of this part of the flange. These last two dimensions are selected so that the flange is mechanically rigid. Therefore, d is a value inversely proportional to the frequency for a chosen height and base width. The curve of FIG. 9 gives the variation in the resonant frequency (in GHz) of the microstrip line as a function of the width d (in mm) of the flange. For example, for a system operating in the 27 to 29 GHz bandwidth, the value of d must be greatly superior to 2.5 mm so that the resonant frequency is displaced far from the operating frequency bandwidth.

Figure 10:
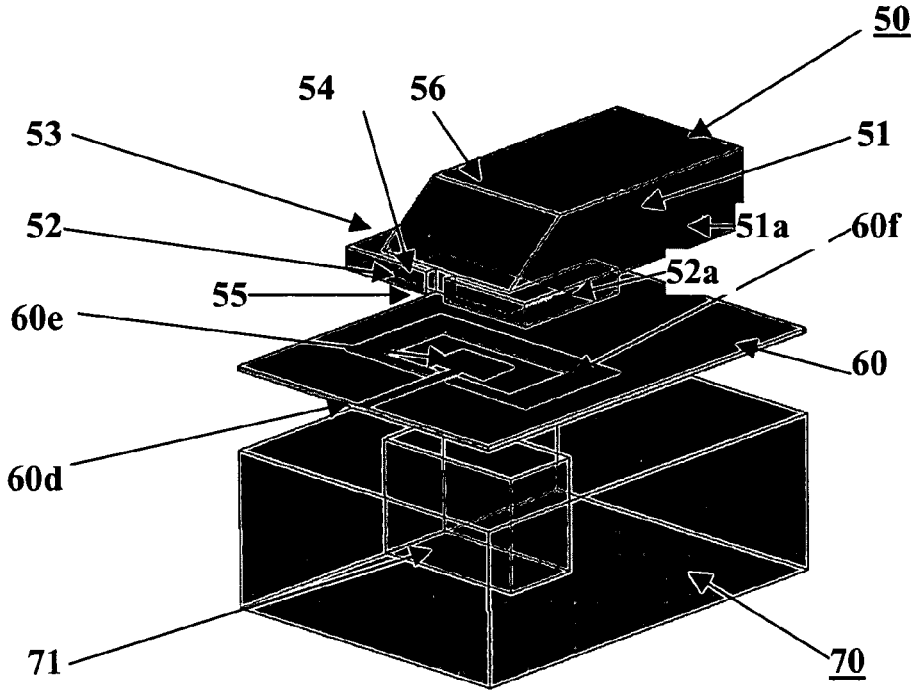
FIG. 10 is an exploded perspective view of a second embodiment of a transition element between a waveguide circuit and a microstrip technology line in accordance with the present invention.
Figure 11:
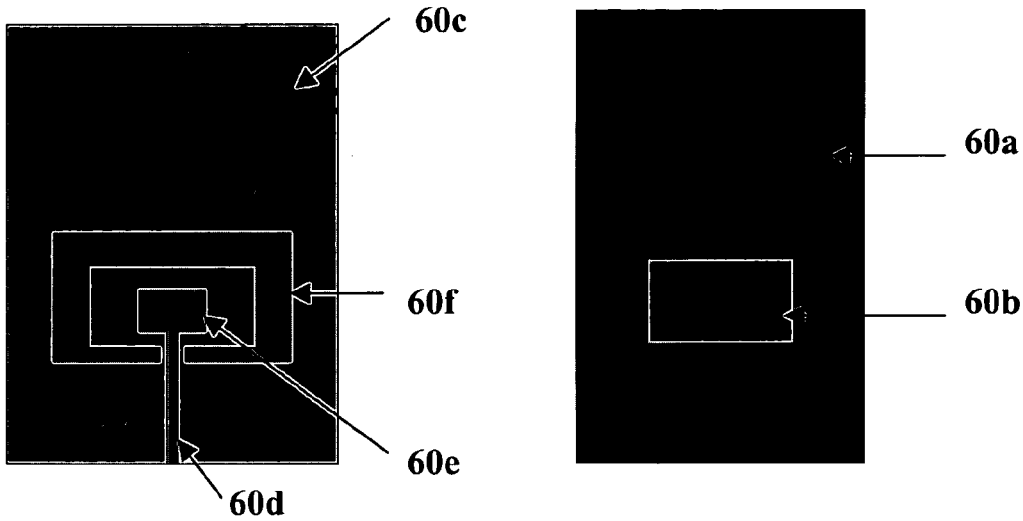
FIGS. 11*a* and 11*b* are respectively a top view and bottom view of the substrate comprising the microstrip technology line used in the second embodiment.

A description will now be given, with reference to FIGS. 10 to 17, of another embodiment of a transition element in accordance with the present invention. In this case, the waveguide circuit 50 comprises a rectangular waveguide 51, the extremity of which is extended by a flange 52 for securing on a substrate 60 featuring planar technology circuits, particularly microstrip, as shown in FIG. 10. Further, the upper part of the rectangular waveguide 56 is shown in FIG. 10.

In this embodiment, the lower plane 52*a* of the flange 52 extends the lower part 51*a* of the rectangular guide in such a manner that the entire waveguide rests on the substrate 60. Moreover, the extremity of the rectangular waveguide terminates by a bevelled part 53. As for the first embodiment, the rectangular waveguide 50 is realized in a solid block of synthetic foam, which can be of the same type as the one used in the realization of FIG. 1. The outer surface of the waveguide and the flange is metallized, with the exception of a rectangular zone 54, in the embodiment shown and which is located above the impedance matching cavity 71 subsequently described in more detail and a zone 55 situated vertically at the interface between the microstrip technology line and the foam block to prevent any short-circuit.

To realize a contact-free connection with planar technology circuits, more particularly microstrip technology, the substrate 60 made of dielectric material comprises, a lower ground plane 60*a* featuring a non-metallized zone 60*b* in the part located opposite the cavity 71, as shown in FIG. 11*b*.

As shown in FIG. 11*a*, on the upper plane 60*c* of the substrate, an access line 60 terminating in a probe 60*e*, which, in the present case was dimensioned to be capacitive, are realized in microstrip technology.

Moreover, to realize the attachment of the waveguide 50 to the substrate 60, the probe 60*e* is surrounded by a conductive footprint 60*f* with a form that corresponds to the lower surface of the flange 52. The attachment of the flange to the footprint is made by welding, particularly by soldering or any other equivalent means. The shape of the footprint will be explained in more detail hereafter. Moreover, the footprint 60*f* is electrically connected to the ground plane 60*a* by metallized holes not shown.

As shown in FIG. 10, the substrate 60 is, moreover, mounted on a metal base or a metal unit 70 which, for the present invention, comprises at the level of the transition a cavity 71 molded or milled in the base 70. The cavity 71 preferably has a cross-section equal to that of the rectangular waveguide and a depth of between $\lambda/4$ and $\lambda/2$, where $\lambda$ represents the guided wavelength in the waveguide. The exact dimension of the depth is chosen so as to optimise the response of the transition element.

In this embodiment, the dimensioning of the flange is realized to facilitate the correct offset of the waveguide on the substrate but also to provide a reliable electrical contact with the printed circuit to provide earth bonding for the entire assembly while avoiding power leakage at the level of the transition. Now, the flange comprises a millimeter waveguide cavity that can interfere with and degrade the performances of the transition. It must therefore be dimensioned correctly.

In this case, the TE10 mode is excited. Therefore, the configuration of the electric field is maximum in the axis of the access line and almost null laterally on the small side of the guide.

Therefore, the flange parts forming cavities located on either side of the access line have few spurious effects on the performances of the system. However, the dimensioning of the opening 55 in the flange 52, essential to the input of the microstrip line 60*d*, is critical. It is necessary to offer an adequate space to prevent disturbances linked to the coupling between the microstrip access line and the metallized zones of the flange. Conversely, an opening that is too large will directly contribute to the significant increase in leaks, this opening being located in a high concentration zone of the electric field.

Figure 12:
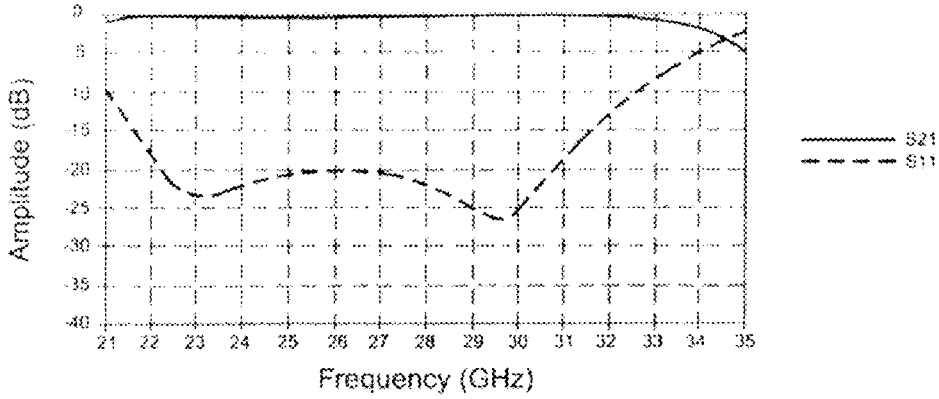
FIG. 12 shows the insertion and return loss curves simulated for a transition: waveguide circuit and microstrip line according to FIG. 10.

The embodiment described below was simulated by using a method identical to the one described for the embodiment of FIG. 1. Hence, for a transition element between a microstrip line realized on a low cost substrate made of a dielectric material of the name ROGER8 R04003 of thickness 0.2 mm and a waveguide as shown in FIG. 10 realized with low loss material (such as a foam known under the commercial name 5 ROHACELL HF71) of standard cross-section WR28: 3.556 mm×7.112 mm and height 1 mm; the results of the simulation with a dimensioning of the guide designed to operate around 30 GHz are shown in FIG. 12, which shows the insertion loss (S21) and return loss (S11) curves simulated for a transition, waveguide circuit, and microstrip line according to FIG. 10. Losses in dB are shown as a function of frequency in GHz.

In this case, the following is obtained:

An impedance matching of more than 20 dB in a very large bandwidth ranging from 22.2 to 30.8 GHz.

An impedance matching of more than 25 dB from 28.9 to 30.1 GHz.

Fairly low insertion losses in the order of 0.25 dB.

Figure 13:
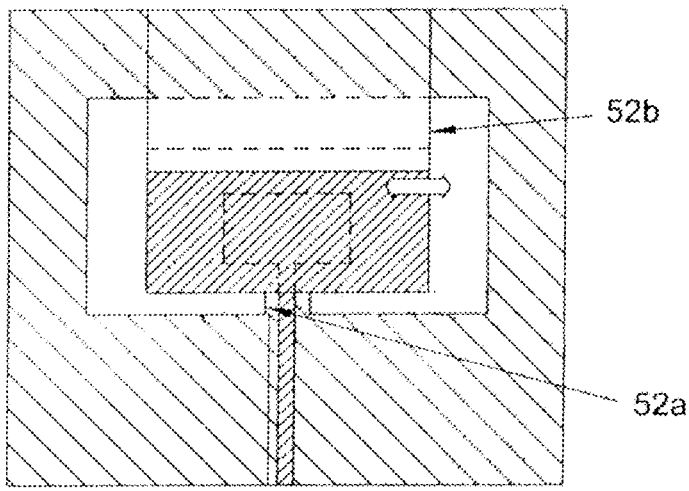
FIG. 13 is a magnified bottom view showing the conductive footprint and the microstrip line on the substrate for an embodiment of FIG. 10.

The influence of dimensions given for the flange 52 on the optimization of the transition will now be described with reference to FIGS. 13 to 17. FIG. 13 diagrammatically showed a top view of the transition element when the waveguide is mounted on the substrate. In this case, the flange 52 comprises two projecting lateral cavities 52*b* with respect to the lateral walls of the guide 51 itself. These two cavities extend by a perpendicular cavity 52*a* featuring an opening 52*c* in its middle, corresponding to the passage of the microstrip line. In this embodiment, as mentioned above, the dimensions of the opening 52*c* have an impact on the electrical performances of the transition such as insertion losses (S21) and return losses (S11), as shown in FIG. 12.

Figure 14:
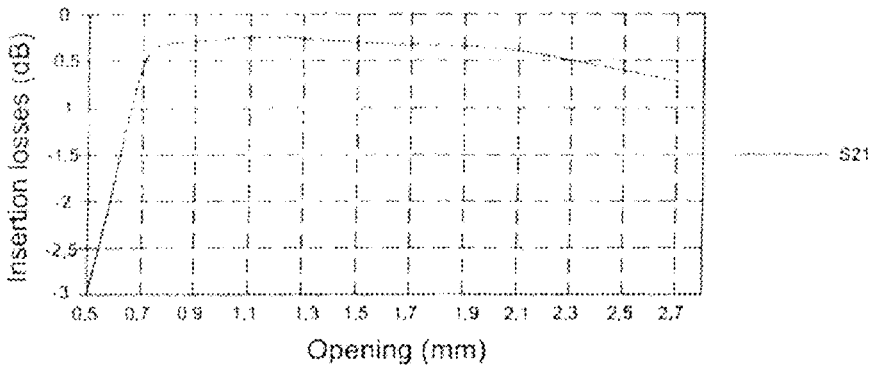
FIG. 14 is a curve giving the insertion losses as a function of the opening width of the footprint for the embodiment of FIG. 10 at 30 GHz.

Hence, as shown in FIG. 14, which gives the insertion losses S21 as function of the width of the opening 52*a*, three distinct zones can be noted:

For an opening less than 0.8 mm, the losses are high, this reflecting the phenomenon of coupling between the line and the metallized walls of the guide.

For an opening varying from 0.8 to 2 mm, we observe a range of optimum values for which the transmission losses are minimum and in the order of −0.25 dB.

For an opening greater the 2 mm, the losses begin to increase, thus resulting in an increase of field leakage.

Figure 15:
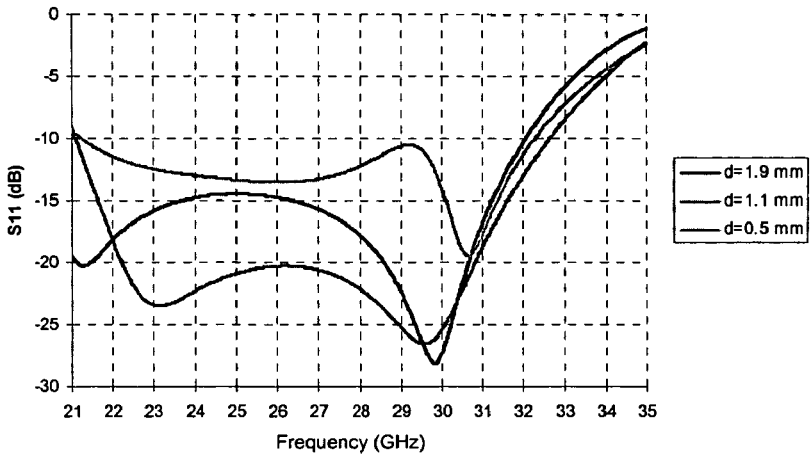
FIGS. 15, 16, 17 show the return loss curves for different footprint dimensions, FIGS. 18*a* and 18*b* respectively show an exploded perspective view of a variant of the embodiment of FIG. 10 for a waveguide circuit comprising an SMD filter and the impedance matching and return loss curves simulated for this variant and, FIGS. 19*a* and 19*b* respectively show an exploded perspective view of another variant of the embodiment of FIG. 10 for a waveguide circuit comprising an SMD pseudo-elliptic filter and the impedance matching and return loss curves simulated for this variant.

Moreover, FIG. 15 shows the return losses (S11) as a function of the width d of the openings found for each of the three previous zones. Curves are shown for d=1.9 mm, d=1.1 mm, and d=0.5 mm Losses in dB are shown as a function of frequency in GHz. The following is therefore observed:

For an opening less than 0.8 mm, the return loss response of to the structure is totally disturbed. The presence, too close, of the extremity of the cavity introduced a notable mismatching.

For an opening varying from 0.8 to 2 mm, the impedance matching is optimum and covers the working bandwidth.

For an opening greater than 2 mm, the beginning of a rise in levels that is related to the leakage by the opening that is too large.

Figure 16:
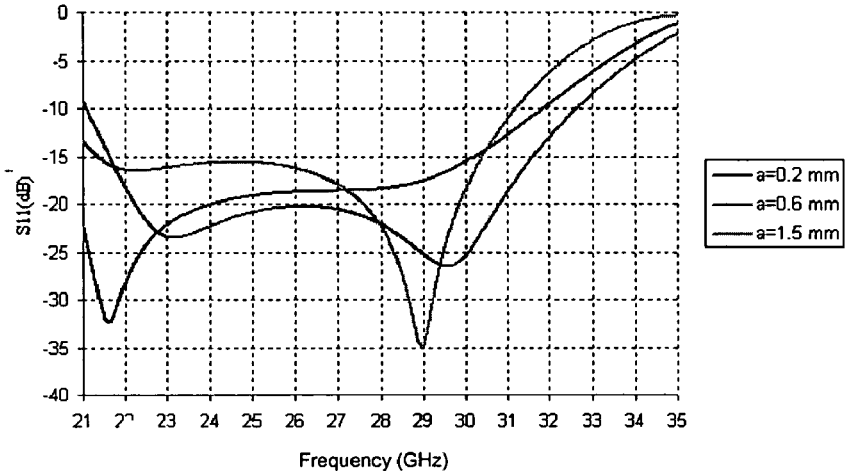
Figure 17:
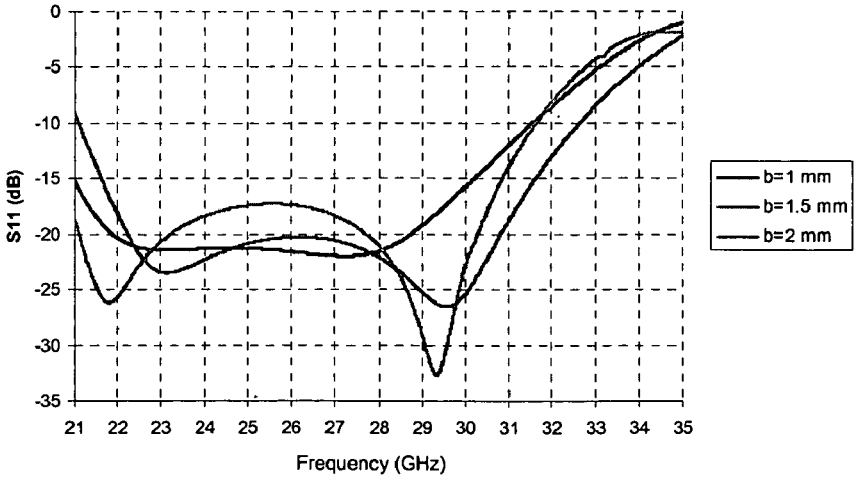

FIGS. 16 and 17 representing the curve S11 (*f*) show the influence on return loss, in dB, of the widths a and b, respectively, of the cavities 52*a*, 52*b* forming the flange on the performances of the transition. FIG. 16 shows the return loss at frequencies from 21 to 35 GHz for widths of cavity 52*a* of 0.2 mm, 0.6 mm, and 1.5 mm FIG. 17 shows the return loss at frequencies from 21 to 35 GHz for widths of cavity 52*b* of 1 mm, 1.5 mm, and 2 mm.

Concerning the cavity a, FIG. 16 shows that the width of this cavity has only a small effect on the return loss response of the transition, the losses always remain below −15 dB, in a wide frequency band, and this for widths varying widely from 0.2 to 1.5 mm.

Concerning the width of the cavity b, FIG. 17 shows that it disturbs the transition performances even less, since by doubling its value from 1 mm to 2 mm, the return losses always remain less than −17 dB in a very wide range of frequency bands.

Figure 18:
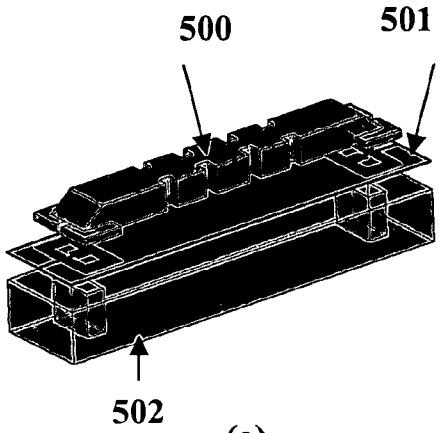
Figure 18:
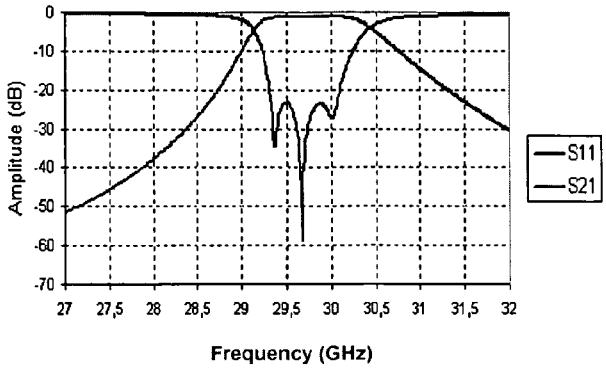
Figure 19:
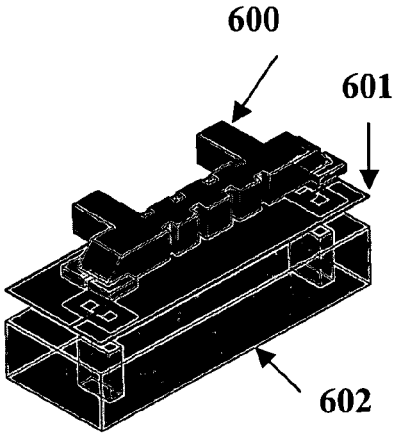
Figure 19:
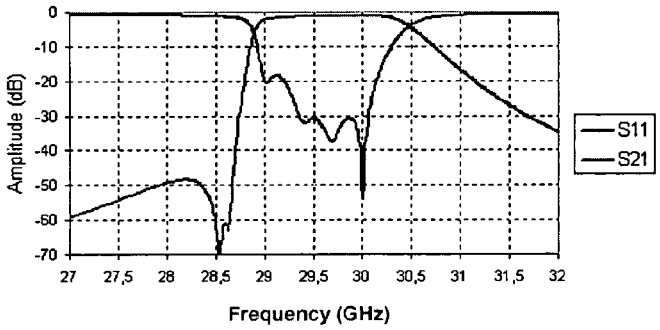

FIGS. 18 and 19 diagrammatically show two embodiment variants of the waveguide circuit used with a transition element of the type described with reference to FIG. 10.

For FIG. 18, the waveguide 500 is an iris waveguide filter of order three showing a Chebyshev type response. The waveguide 500 is connected to planar technology circuits by using a transition element as described above. Hence, FIG. 18*a* diagrammatically shows the substrate 501 featuring connection footprints and access lines and the base 502 featuring a cavity opposite the output of the filter 500.

FIGS. 18*a* and 18*b* respectively show an exploded perspective view of a variant of the embodiment of FIG. 10 for a waveguide circuit comprising an SMD filter and the impedance matching and return loss curves simulated for this variant. FIGS. 19*a* and 19*b* respectively show an exploded perspective view of another variant of the embodiment of FIG. 10 for a waveguide circuit comprising an SMD pseudo-elliptic filter and the impedance matching and return loss curves simulated for this variant. The curves of FIGS. 18*b* and 19*b* represent the insertion losses (S21) and return losses (S11) in dB for frequencies from 27 to 32 GHz. The following can be noted:

Low insertion losses in the order of 1.2 dB, for a frequency range of 900 MHz around 30 GHz.

Return losses lower than −23 dB on this same frequency range.

FIG. 19 is similar to FIG. 18 and shows a waveguide 600 containing a pseudo-elliptic filter comprising two stubs placed at each input of the waveguide. The purpose of this device is to create two transmission zeros locally outside of the bandpass thus increasing the selectivity of the filter. This surface mounted filter 600 on a substrate 601 RO4003 and a base 602 featuring a cavity and excited by two microstrip lines was fully simulated in 3D. FIG. 19*b* shows the performances obtained:

Insertion losses in the order of 1.2 dB in a pass band of 1 GHz around 30 GHz.

Return losses less than −30 dB at the [29.5-30.0] GHz bandwidth.

Attenuation of more than 60 dB at 28.55 GHz, the frequency corresponding to a spurious frequency to reject.

A description will now be given, with reference to FIGS. 20 to 22, of another embodiment of a transition element in accordance with the present invention. In this case, the waveguide circuit 80 comprises a rectangular waveguide 81 for which the extremity extends by an element 82 forming the securing flange. In this embodiment, the waveguide is formed by a block of dielectric material that can be a synthetic foam of permittivity equivalent to that of air. The block was hollowed out to form a cavity 83 and the outer surface of the block is fully metallized Moreover, the flange 82 has a slot 84 whose role will be explained hereafter. In the embodiment, the lower plane of the flange 82 extends the lower hollowed out part of the rectangular guide 81 such that the waveguide rests on the substrate 90 receiving the planar technology circuits, particularly microstrip.

Figure 20:
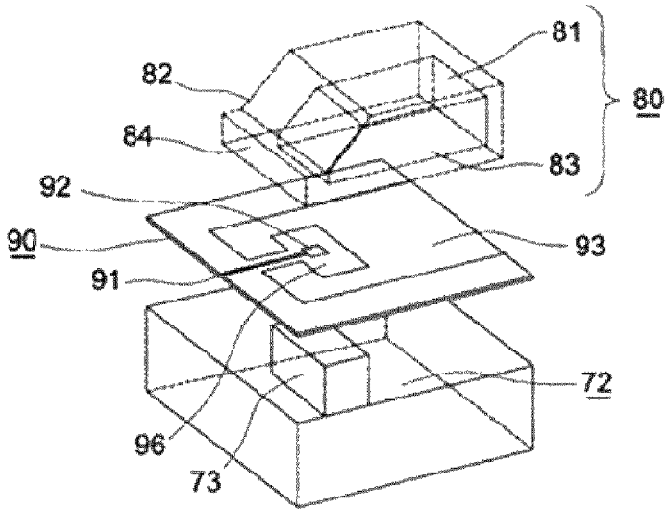
FIG. 20 is an exploded perspective view of a second embodiment of a transition element between a waveguide circuit and a microstrip technology line in accordance with the present invention.
Figure 21A:
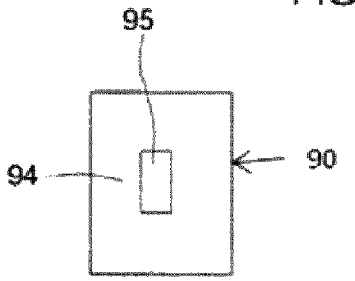
FIGS. 21*a* and 21*b* are respectively a bottom view and top view of the substrate comprising the microstrip technology line used in the third embodiment.
Figure 21B:
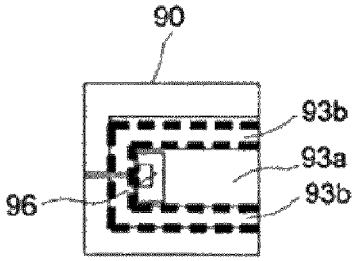

As shown in FIGS. 20, 21*a* and 21*b*, the substrate 90 in microwave dielectric material comprises a foam plane marked 94 in FIG. 21*a*, this ground plane featuring a non-metallized area 95 (FIG. 21*a*) in the part that is located opposite the waveguide output at the level of the transition. Moreover, in this embodiment, the upper plane of the substrate 90 comprises a metallized zone 93 (FIG. 20) consisting a first metallized zone 93*b* (FIG. 21*b*) being used to offset the waveguide 80 (FIG. 20).

This zone 93*b* is connected electrically to the ground plane 94 by metallized holes not shown. Moreover, the substrate 90 comprises a second metallized zone 93*a* (FIG. 21*b*) placed within the zone 93*b* and which extends under the entire opening of the waveguide 80 so as to form a cover closing the opening 83 of the waveguide.

The upper face of the substrate 90 also comprises a non-metallized zone 96 (FIG. 20, 21*b*) corresponding to the zone 95. This zone 96 (FIG. 21*b*) receives the extremity 92 or "probe" of a feeding line 91 realized in printed circuit technology, particularly microstrip. This line crosses a non-metallized zone in the zone 93*a* which corresponds to the gap 84 in the flange 82.

The assembly is mounted on a metal base or metal box 72 which, for the present invention, comprises a cavity 73 at the level of the transition molded or milled in the base, as shown in FIG. 20. The cavity has a cross-section noticeably equal to that of the waveguide extremity, namely, corresponding to the non-metallized zone 95 and a depth of between $\lambda/4$ and $\lambda/2$, where $\lambda$ represents the guided wavelength in the waveguide.

The embodiment described above was simulated by using a method identical to the one described for the previous embodiments. Hence, the substrate is constituted by a dielectric material known under the name of ROGERS R04003 of thickness 0.2 mm. The waveguide is realized in a block 30 of dielectric material that was milled in such a manner that the inner cross-section of the waveguide is equivalent to the standard WR28: 3.556 mm×7.112 mm and presents a thickness of 2 mm. The guide was metallized with conductive materials such as tin, copper, etc. The system was designed to operate at 30 GHz. The curves of FIG. 22 represent the insertion losses (S21) and return losses (S11) in dB for frequencies from 22 to 40 GHz for a transition according to the embodiment shown in FIG. 20.

Figure 22:
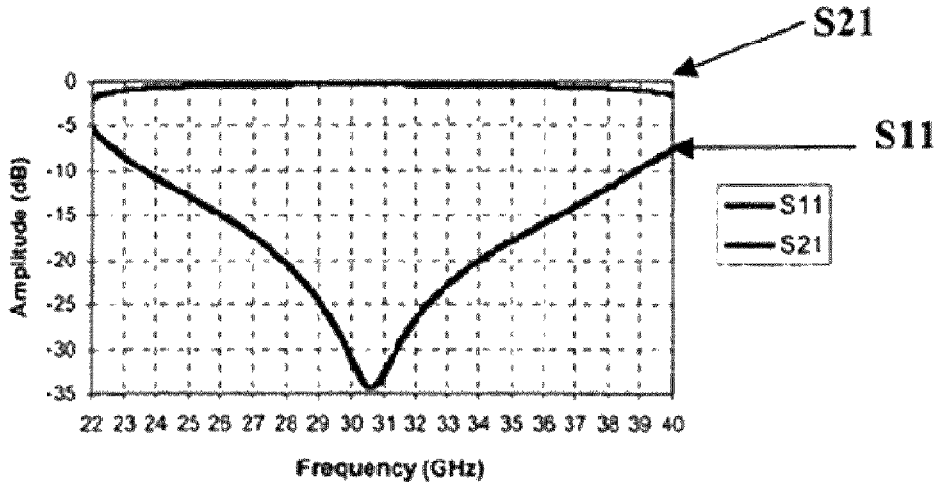
FIG. 22 shows the insertion and return loss curves simulated for a transition according to FIG. 20.

In this case, as shown in FIG. 22 which concerns a single microstrip line/waveguide transition, the following is obtained:

an impedance matching of more than 15 dB in a very large bandwidth ranging from 26 GHz and 36 GHz, fairly low insertion losses in the order of 0.4 dB in this frequency band.

It is evident to those in the art that the waveguide 80 described above can be modified to realize an iris waveguide filter featuring a Chebyshef type response of the type of the one shown in FIG. 18 or a pseudo-elliptical filter with two stubs placed at each input of the waveguide of the type shown in FIG. 19.

It is evident to those in the art that many modifications can be made to the embodiments described above. In particular, one can envisage obtaining an independent transition element for some embodiments into which the extremity of the waveguide is inserted. The important factor is to realize a contact-free transition that shows no spurious resonance modes.

What is claimed is:

1. A transition element for a perpendicular contact-free connection between a waveguide circuit and a microstrip technology line realized on a dielectric substrate, the transition element being mounted at an extremity of the waveguide circuit and comprising a securing flange for attachment to the substrate, said substrate featuring a conductive footprint for making the connection to a lower surface of the flange, and a cavity dimensioned for impedance matching with the waveguide circuit being realized opposite the extremity of the waveguide under the substrate, wherein the securing flange has a width d in the direction of the microstrip line, chosen to shift resonating modes away from an operating frequency band, d being a value inversely proportional to resonant frequency for a given height and width of the securing flange, the securing flange being an element fixed to the extremity of the waveguide, wherein the substrate receives the microstrip technology line, at the extremity of the line.

2. The transition element according to claim 1, wherein the waveguide circuit and the securing flange are realized in a block of synthetic material with the external surfaces thereof metallized except for a zone opposite the cavity.

3. The transition element according to claim 1, wherein the cavity has a depth between $\lambda/4$ and $\lambda/2$ where $\lambda$ corresponds to the guided wavelength in the waveguide.

4. The transition element according to claim 1, wherein the conductive footprint realized on the substrate comprises a first metallized zone to which the waveguide is fixed and a second metallized zone inside the first zone, said second metallized zone comprising a cover for the waveguide.

5. The transition element according to claim 1, wherein the microstrip line terminates in a probe.

6. The transition element according to claim 1, wherein the conductive footprint has a C shape, the C-shaped conductive footprint having branches with an opening there between being dimensioned to limit the leakage of electrical fields while preventing short circuits.

7. The transition element according to claim 1, wherein the waveguide is comprised of a hollowed out block of dielectric of which the external surface thereof is metallized.

8. The transition element according to claim 7, wherein the conductive footprint extends under the hollowed out part of the waveguide so as to comprise a cover.

9. A transition element for a perpendicular contact-free connection between a waveguide circuit and a microstrip technology line realized on a dielectric substrate, the transition element being mounted at an extremity of the waveguide circuit and comprising a securing flange for attachment to the substrate, said substrate featuring a conductive footprint for making the connection to a lower surface of the flange, and a cavity dimensioned to realize impedance matching with the waveguide circuit being realized opposite the extremity of the waveguide under the substrate, wherein the conductive footprint realized on the substrate comprises a first metallized zone to which the waveguide is fixed and a second metallized zone inside the first zone, said second metallized zone comprising a cover for the waveguide.

10. The transition element according to claim 9, wherein the securing flange has a width d in the direction of the microstrip line, chosen to shift resonating modes away from an operating frequency band, d being a value inversely proportional to resonant frequency for a given height and width of the securing flange.

11. The transition element according to claim 9, wherein the conductive footprint has a C shape, the C-shaped conductive footprint having branches with an opening there between being dimensioned to limit the leakage of electrical fields while preventing short circuits.

* * * * *